US008079539B2

(12) United States Patent
Huang et al.

(10) Patent No.: US 8,079,539 B2
(45) Date of Patent: Dec. 20, 2011

(54) BUILT-IN MODULE FOR INVERTER AND HAVING TENSION CONTROL WITH INTEGRATED TENSION AND VELOCITY CLOSED LOOPS

(75) Inventors: Chien-Ping Huang, Taipei (TW); Cheng-Hsiang Kuo, Taipei (TW)

(73) Assignee: Delta Electronics, Inc., Taoyuan Shien (TW)

( * ) Notice: Subject to any disclaimer, the term of this patent is extended or adjusted under 35 U.S.C. 154(b) by 201 days.

(21) Appl. No.: 12/693,848

(22) Filed: Jan. 26, 2010

(65) Prior Publication Data

US 2011/0180649 A1 Jul. 28, 2011

(51) Int. Cl.
*B65H 23/18* (2006.01)

(52) U.S. Cl. ..... 242/412.1; 242/412.2; 242/412.3

(58) Field of Classification Search ..... 242/410, 242/412.1–412.3

See application file for complete search history.

(56) References Cited

U.S. PATENT DOCUMENTS 3,910,527 A * 10/1975 Buhler et al. ..... 242/334.2
4,015,799 A * 4/1977 Koski et al. ..... 242/334.4
4,163,532 A * 8/1979 Sakai ..... 242/334.2
4,332,359 A * 6/1982 Berti ..... 242/412.1
4,522,351 A * 6/1985 Yessian et al. ..... 242/412.1
4,525,654 A * 6/1985 Tajima et al. ..... 318/7
4,664,336 A * 5/1987 Koyama ..... 242/334.3
4,801,853 A * 1/1989 Lewis et al. ..... 318/7
4,807,107 A * 2/1989 Fincher ..... 700/126
4,977,466 A * 12/1990 Nakata ..... 242/334.3
5,012,989 A * 5/1991 Whyte et al. ..... 242/334
5,032,938 A * 7/1991 Tajima et al. ..... 360/73.09

* cited by examiner

*Primary Examiner* — Sang Kim
(74) *Attorney, Agent, or Firm* — Muncy, Geissler, Olds & Lowe, PLLC

(57) ABSTRACT

A built-in module for an inverter and having tension control with integrated tension and velocity closed loops, where required tension feedbacks can be obtained by internal calculations of the inverter or feedback signals of a tension sensor. The tension control module is applied to provide a tension control for a winding mechanism which is operated by driving at least one motor. The tension control module firstly builds a tension control to provide a balanced tension to the winding mechanism. Afterward, the tension control module builds a velocity control to provide an accelerated or decelerated adjustment for the winding mechanism. Accordingly, the winding mechanism can stably maintain a tension-balanced operation.

6 Claims, 4 Drawing Sheets

BUILT-IN MODULE FOR INVERTER AND HAVING TENSION CONTROL WITH INTEGRATED TENSION AND VELOCITY CLOSED LOOPS

BACKGROUND OF THE INVENTION

1. Field of the Invention

The present invention relates to a tension module, and more particularly to a built-in module for an inverter and having tension control with integrated tension and velocity closed loops.

2. Description of Prior Art

For machine equipment of papermaking, metal-manufacturing, textile, plastic-manufacturing, or cable industries, a tension-balance control is an essential and important requirement to ensure consistent qualities of manufactured products.

PID (Proportional-Integral-Derivative) controllers are focused much attention and are most commonly used in industrial control because the PID controllers are simple and easy to implement. More particularly, the PID controllers can be employed to eliminate steady-state errors and to obtain relative stability and damping characteristics of controlled systems.

Nowadays, a line speed control is the major control scheme for a tension control system which is built in an inverter. In this scheme, however, the line speed (not the tension force) is the major controlled variable. Thus, an unbalanced tension control tends to happen due to inconsistent line speeds when machine equipment is instantaneously started or stopped and even is operated under a tremendous speed-varying condition.

Reference is made to FIG. 1 which is a schematic view of providing a tension control for a winding mechanism by driving a motor through a prior art inverter. The scheme of the tension control for the winding mechanism mainly includes two inverters (namely, a first inverter 14*a* and a second inverter 24*a*) and two motors (namely, a first motor 12*a* and a second motor 22*a*). The winding mechanism is referred to as a controlled mechanical system 100*a*. The controlled mechanical system 100*a* mainly includes a first rotating shaft 10*a*, a second rotating shaft 20*a*, a winding object 30*a*, and a sensing unit 40*a*. The first rotating shaft 10*a* and the second rotating shaft 20*a* are used to rotate the winding object 30*a* in the winding process. The first inverter 14*a* is electrically connected to the first motor 12*a*, and the first motor 12*a* is mechanically connected to the first rotating shaft 10*a*. The first inverter 14*a* is provided to drive the first motor 12*a* to rotate the first rotating shaft 10*a*. Similarly, the second inverter 24*a* is electrically connected to the second motor 22*a*, and the second motor 22*a* is mechanically connected to the second rotating shaft 20*a*. The second inverter 24*a* is provided to drive the second motor 22*a* to rotate the second rotating shaft 20*a*. In addition, the first motor 12*a* and the second motor 22*a* further install a first encoder 16*a* and a second encoder 26*a* onto a shaft to measure the angular velocity thereof, respectively, in a closed-loop velocity control.

The sensing unit 40*a* is installed between the first rotating shaft 10*a* and the second rotating shaft 20*a*. The sensing unit 40*a* can be a tension sensor or a line speed sensor to sense the magnitude of the tension force and the velocity of the winding object 30*a* between the first rotating shaft 10*a* and the second rotating shaft 20*a*, respectively. Furthermore, the sensed magnitude of the tension force and the sensed velocity are used for a closed-loop tension control and a velocity control.

However, the use of either the tension sensor or the line speed sensor results in higher equipment costs and different feedback sources. Thus, it is not convenient for users to adjust and control the conventional inverters with tension control functions because different control modes and parameters have to be properly set.

Accordingly, it is desirable to provide a built-in module for an inverter and having tension control with integrated tension and velocity closed loops for an easy-use, high-acceptable, and wide-applicable tension-balanced control without any sensor.

SUMMARY OF THE INVENTION

In order to solve the above-mentioned problems, a built-in module for an inverter and having a tension control with integrated tension and velocity closed loops is disclosed. The tension control module is applied to provide a tension control for a winding mechanism which is operated by driving at least one motor. The tension control module includes a first arithmetic unit, a second arithmetic unit, a tension controller, a tension feedback calculation unit, a third arithmetic unit, a velocity controller, and a fourth arithmetic unit.

The first arithmetic unit receives an external tension command. The second arithmetic unit receives an external velocity command. The tension controller is electrically connected to the first arithmetic unit to receive a tension force difference and perform a PID operation to the tension force difference to output a torque. The tension feedback calculation unit is electrically connected to the first arithmetic unit to receive an angular velocity outputted from the motor and the torque calculated by the tension controller to output a feedback tension force; wherein the tension force difference is obtained by subtracting the feedback tension force from the external tension command through the first arithmetic unit. The third arithmetic unit is electrically connected to the tension feedback calculation unit to multiply the feedback tension force outputted from the tension feedback calculation unit by a winding radius of a rotating shaft of the winding mechanism to obtain a resisting torque. The velocity controller is electrically connected to the second arithmetic unit to receive a velocity difference and perform a PID operation to the velocity difference to output a compensation torque; wherein the velocity difference is obtained by subtracting the angular velocity from the external velocity command through the second arithmetic unit. The fourth arithmetic unit is electrically connected to the tension controller, the tension feedback calculation unit, the velocity controller, and the third arithmetic unit to obtain a net torque by subtracting the resisting torque from the torque to build a tension control; further the net torque is added by the compensation torque to obtain another net torque to build a velocity control.

Therefore, the tension control module firstly builds the tension control to provide a balanced tension to the winding mechanism; afterward, the tension control module builds the velocity control to provide an accelerated or decelerated adjustment for the winding mechanism so that the winding mechanism can stably maintain a tension-balanced operation.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

Figure 1:
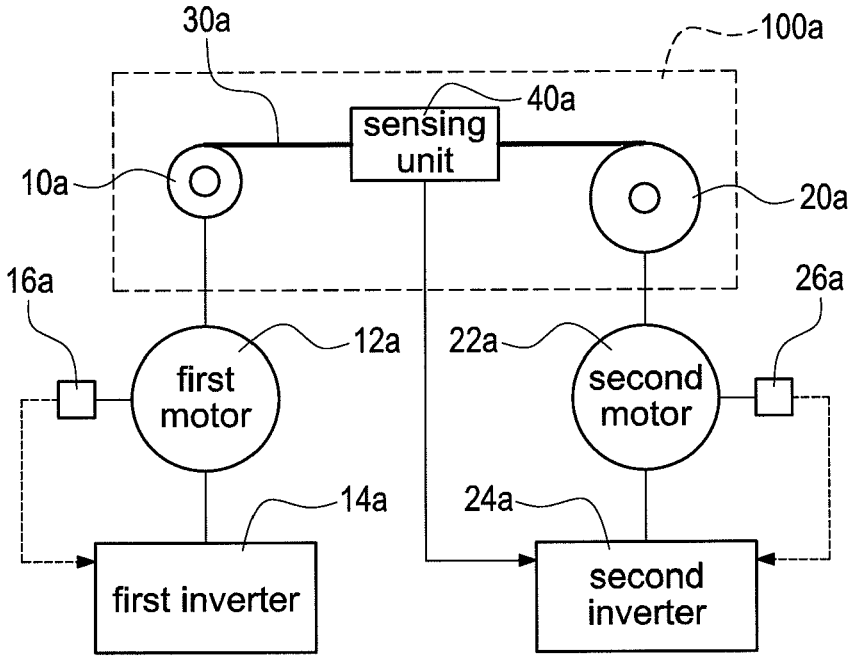
FIG.1 PRIOR ART
FIG. 1 is a schematic view of providing a tension control for a winding mechanism by driving a motor through a prior art inverter.

Reference will now be made to the drawing figures to describe the present invention in detail.

Figure 2:
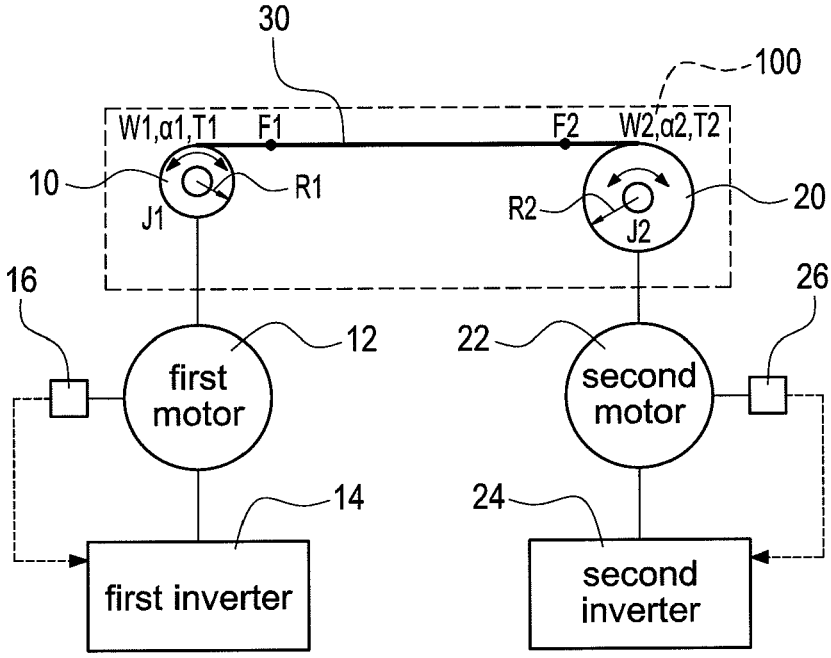
FIG. 2 is a schematic view of providing a tension control for a winding mechanism by driving a motor through an inverter according to the present invention.

Reference is made to FIG. 2 which is a schematic view of providing a tension control for a winding mechanism by driving a motor through an inverter according to the present invention. In the winding mechanism, a tension sensor or a line speed sensor is absent (namely, not necessary). The scheme of the tension control for the winding mechanism mainly includes two inverters (namely, a first inverter 14 and a second inverter 24) and two motors (namely, a first motor 12 and a second motor 12). The winding mechanism is referred to as a controlled mechanical system 100. The controlled mechanical system 100 mainly includes a first rotating shaft 10, a second rotating shaft 20, and a winding object 30. The first rotating shaft 10 and the second rotating shaft 20 are used to rotate the winding object 30 in the winding process. The first inverter 14 is electrically connected to the first motor 12, and the first motor 12 is mechanically connected to the first rotating shaft 10. The first inverter 14 is provided to drive the first motor 12 to rotate the first rotating shaft 10. Similarly, the second inverter 24 is electrically connected to the second motor 22, and the second motor 22 is mechanically connected to the second rotating shaft 20. The second inverter 24 is provided to drive the second motor 22 to rotate the second rotating shaft 20. In addition, the first motor 12 and the second motor 22 further install a first encoder 16 and a second encoder 26 onto a shaft to measure the angular velocity thereof, respectively, in a closed-loop velocity control.

More particularly, a line tension force of the winding object 30 is calculated by a first inverter 14 and a second inverter 24 for a PID controller. Besides, a tension command is a desired value for the tension control. The detailed description of the above-mentioned PID control will be made hereinafter with reference to FIG. 3 and FIG. 4.

The present invention provides a tension control strategy: a tension adjustment is as the main control and a velocity adjustment is as the auxiliary control. Namely, for controlling the controlled mechanical system 100, a tension control is firstly built to provide a balanced tension to the winding object 30; afterward, a velocity control is built to provide an accelerated or decelerated adjustment for the winding object 30. Accordingly, the winding object 30 can be stably controlled under a tension-balanced operation. The detailed description of the tension control and the velocity control will be made hereinafter with reference to FIG. 3 and FIG. 4, respectively.

Figure 3:
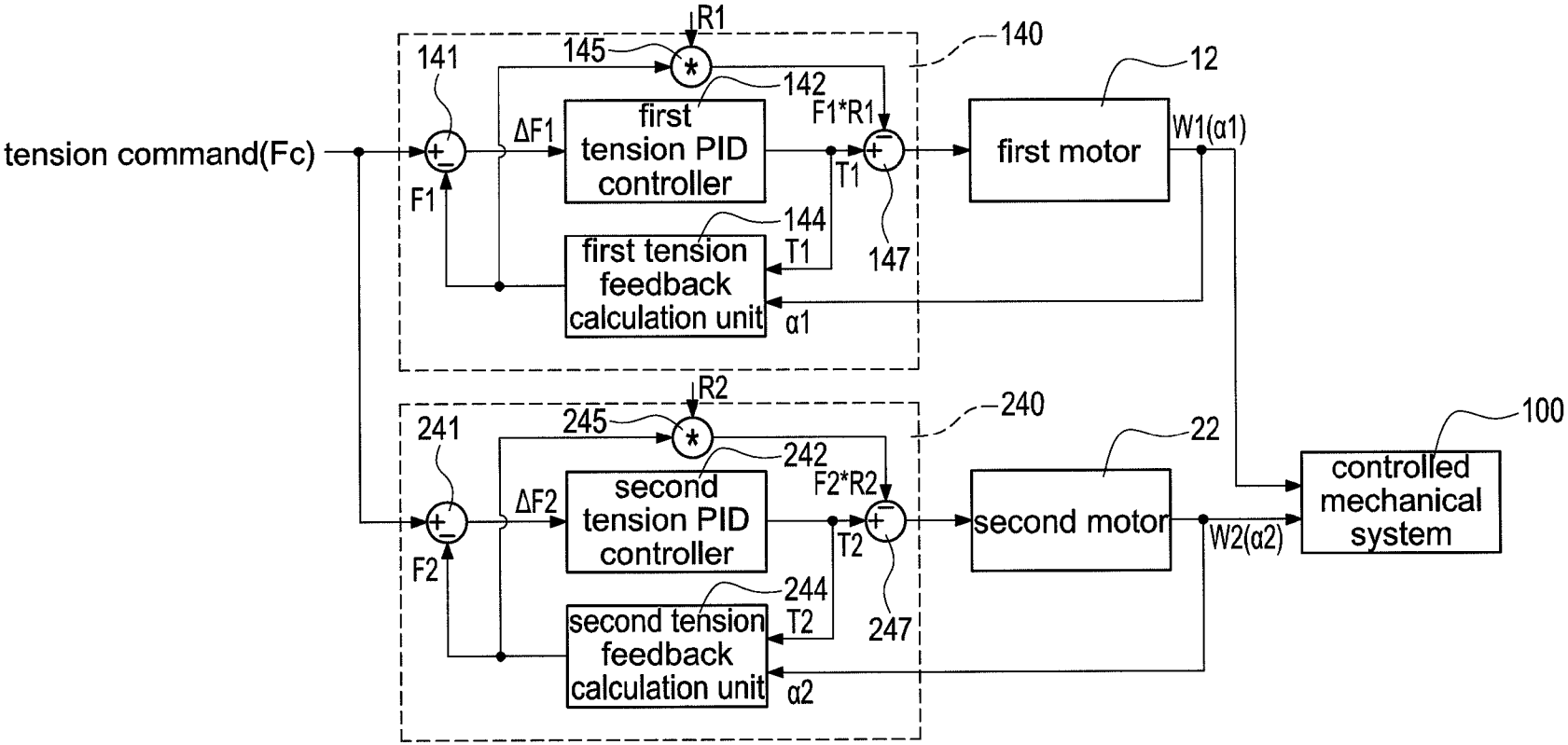
FIG. 3 is a block diagram of a tension control with tension closed loops.

Reference is made to FIG. 3 which is a block diagram of a tension control with tension closed loops. In this example, a winding mechanism is exemplified for further demonstration. With reference to FIG. 2, the controlled mechanical system 100 has the following parameters:

a first winding radius R1 represents a radius of the first rotating shaft 10;

a first rotational inertia J1 represents a moment of inertia of the first rotating shaft 10;

a first angular velocity W1 represents a rotating velocity of the first rotating shaft 10 (namely, the first motor 12);

a first torque T1 represents a generated torque of the first rotating shaft 10;

a first angular acceleration α1 represents a rotating acceleration of the first rotating shaft 10 (namely, the first motor 12);

a first tension force F1 represents a tension force of the winding object 30 near the first rotating shaft 10;

a second winding radius R2 represents a radius of the second rotating shaft 20;

a second rotational inertia J2 represents a moment of inertia of the second rotating shaft 20;

a second angular velocity W2 represents a rotating velocity of the second rotating shaft 20 (namely, the second motor 22);

a second torque T2 represents a generated torque of the second rotating shaft 20;

a second angular acceleration α2 represents a rotating acceleration of the second rotating shaft 20 (namely, the second motor 22); and a second tension force F2 represents a tension force of the winding object 30 near the second rotating shaft 20.

Dynamic equations of the controlled mechanical system 100 can be represented as follows:

$$T1-F1\times R1=J1\times\alpha1$$

$$T2-F2\times R2=J2\times\alpha2$$

Accordingly, the line tension force of the winding object 30 can be represented as follows:

$$F1=(T1-J1\times\alpha1)/R1 \quad \text{(equation 1)}$$

$$F2=(T2-J2\times\alpha2)/R2 \quad \text{(equation 2)}$$

In addition, the first angular velocity W1 (or the first angular acceleration α1) and the second angular velocity W2 (or the second angular acceleration α2) can be obtained from the first motor 12 and the second motor 22, respectively. Hence, the tension feedback parameters of the winding mechanism can be calculated to perform the PID operations (including a proportional operation, an integral operation, and a derivative operation) so as to obtain a torque command to control the first motor 12 and the second motor 22 to balance the first tension force F1 and the second tension force F2.

The first inverter 14 and the second inverter 24 are built-in the first tension control module 140 and the second tension control module 240, respectively. The first tension control module 140 has a first tension PID controller 142, a first tension feedback calculation unit 144, a first arithmetic unit 141, a third arithmetic unit 145, and a fourth arithmetic unit 147. The second tension control module 240 has a second tension PID controller 242, a second tension feedback calculation unit 244, a first arithmetic unit 241, a third arithmetic unit 245, and a fourth arithmetic unit 247. Also, an external tension command Fc is received by the first arithmetic unit 141 and the first arithmetic unit 241, respectively.

The first tension feedback calculation unit 144 is electrically connected to the first arithmetic unit 141 to receive the first torque T1 outputted from the first tension PID controller 142 and the first angular acceleration α1 outputted from the first motor 12. Because the first winding radius R1 and the first rotational inertia J1 are given after the first rotating shaft 10 being designed, the first tension force F1 can be calculated according the equation 1 and the equation 2. In addition, a first tension force difference ΔF1 is calculated by subtracting the first tension force F1 from the tension command Fc (namely, ΔF1=Fc−F1). The first tension force difference ΔF1 is the difference between the expected tension force and the actual tension force generated from the first tension control module 140. The first tension PID controller 142 is electrically connected to the first arithmetic unit 141 and receives the first tension force difference ΔF1 to perform a PID operation to the first tension force difference ΔF1 to output the first torque T1. In addition, the third arithmetic unit 145 is electrically connected to the first tension feedback calculation unit 144 to multiply the first tension force F1 (outputted from the first tension feedback calculation unit 144) and the first winding radius R1 of the first rotating shaft 10 to obtain a first resisting torque (F1×R1) of the first rotating shaft 10. Because a direction of the first resisting torque (F1×R1) is opposite to that of the first torque T1, the net torque of the first motor 12 is equal to the difference between the first torque T1 and the first resisting torque (F1×R1). More particularly, the first motor 12 is driven by a first motor drive (not shown) according to the torque mode to rotate the first rotating shaft 10 of the controlled mechanical system 100 so as to build the tension control.

Similarly, the second tension feedback calculation unit 244 is electrically connected to the second arithmetic unit 241 to receive the second torque T2 outputted from the second tension PID controller 242 and the second angular acceleration α2 outputted from the second motor 22. Because the second winding radius R2 and the second rotational inertia J2 are given after the second rotating shaft 20 being designed, the second tension force F2 can be calculated according the equation 1 and the equation 2. In addition, a second tension force difference ΔF2 is calculated by subtracting the second tension force F2 from the tension command Fc (namely, ΔF2=Fc−F2). The second tension force difference ΔF2 is the difference between the expected tension force and the actual tension force generated from the second tension control module 240. The second tension PID controller 242 is electrically connected to the second arithmetic unit 241 and receives the second tension force difference ΔF2 to perform a PID operation to the second tension force difference ΔF2 to output the second torque T2. In addition, the third arithmetic unit 245 is electrically connected to the second tension feedback calculation unit 244 to multiply the second tension force F2 (outputted from the second tension feedback calculation unit 244) and the second winding radius R2 of the second rotating shaft 20 to obtain a second resisting torque (F2×R2) of the second rotating shaft 20. Because a direction of the second resisting torque (F2×R2) is opposite to that of the second torque T2, the net torque of the second motor 22 is equal to the difference between the second torque T2 and the second resisting torque (F2×R2). More particularly, the second motor 22 is driven by a second motor drive (not shown) according to the torque mode to rotate the second rotating shaft 20 of the controlled mechanical system 100 so as to build the tension control.

In the present invention, a first encoder 16 and a second encoder 26 are installed onto a shaft of the first motor 12 and the second motor 22, respectively, to measure the first angular velocity W1 and the second angular velocity W2. Furthermore, the first angular velocity W1 and the second angular velocity W2 can be obtained by using a velocity estimation method, where the first encoder 16 and the second encoder 26 are absent.

Figure 5:
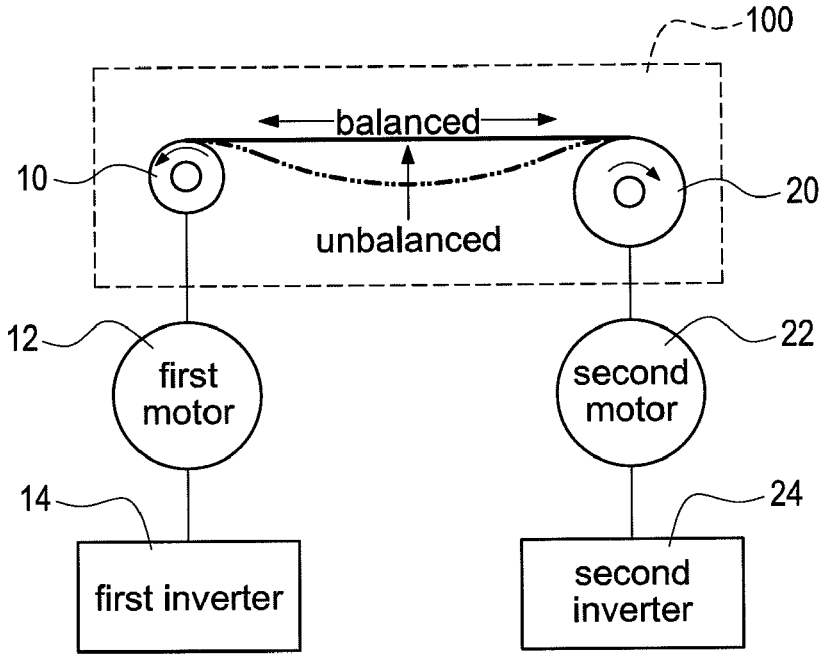
FIG. 5 is a schematic view of building the tension control.

The above-mentioned tension control closed loops based on the torque control mode are employed to drive the first motor 12 and the second motor 22 to provide the balanced tension for the winding object 30. Reference is made to FIG. 5 which is a schematic view of building the tension control. When the winding object 30 is in an unbalanced condition, the first motor 12 and the second motor 22 are driven to rotate slowly in different directions. In this example, the first motor 12 rotates in counter clockwise direction and the second motor 22 rotates in clockwise direction, respectively. Accordingly, once the force difference between the first tension force F1 and the second tension force F2 are zero (or in a range of allow error), the tension control is done.

Figure 4:
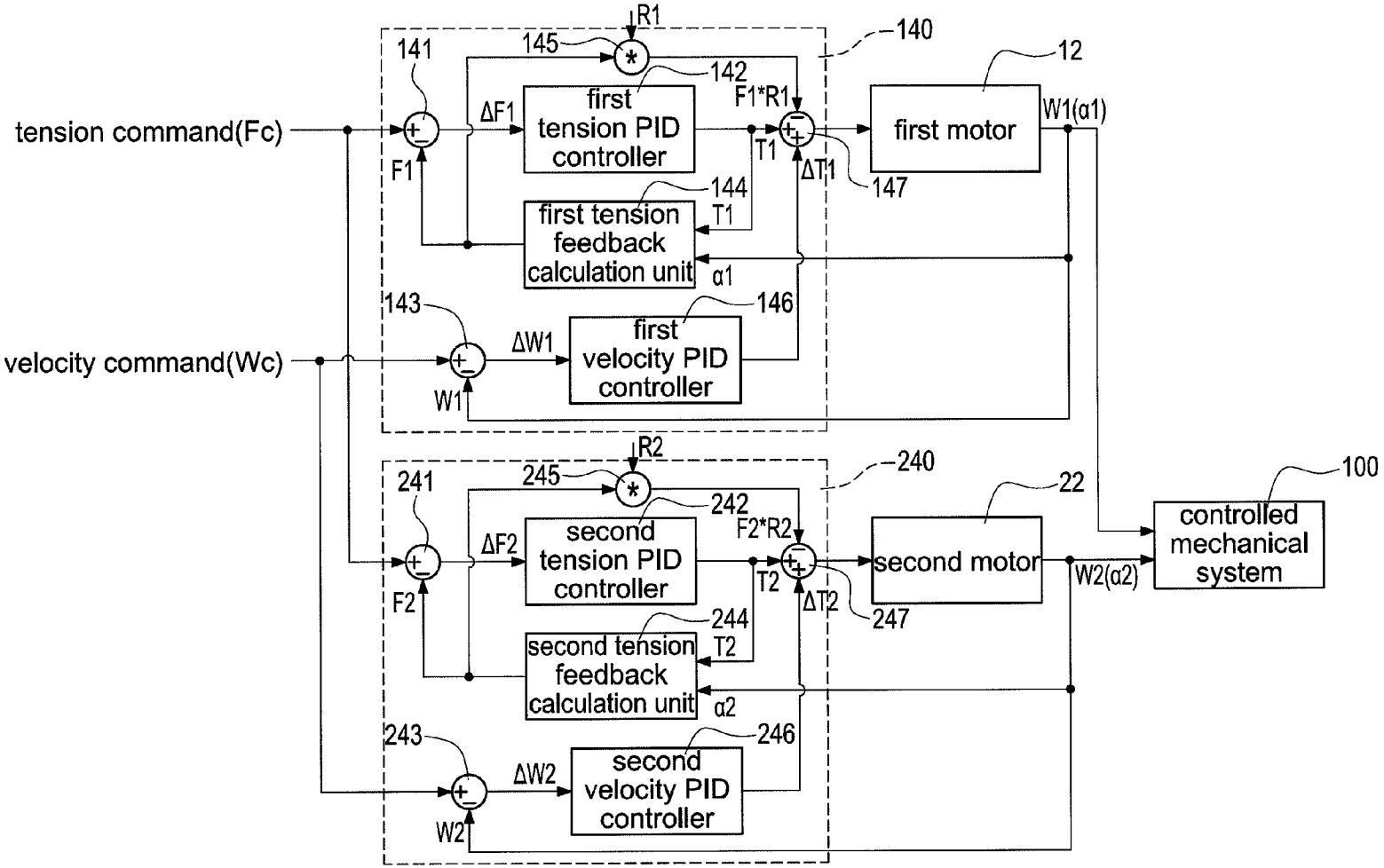
FIG. 4 is a block diagram of the tension control with integrated tension and velocity closed loops.

Reference is made to FIG. 4 which is a block diagram of the tension control with integrated tension and velocity closed loops. Once the winding object 30 is in a balanced condition, and then the velocity control is performed. As shown in FIG. 4, a first velocity PID controller 146 of the first tension control module 140 and a second velocity PID controller 246 of the second tension control module 240 are introduced, respectively. Also, an external velocity command Wc is received by the second arithmetic unit 143 and the second arithmetic unit 243, respectively.

The second arithmetic unit 143 is used to calculated a first velocity difference ΔW1, which is calculated by subtracting the first angular velocity W1 from the velocity command Wc (namely, ΔW1=Wc−W1). The first velocity difference ΔW1 is the difference between the expected velocity and the actual velocity generated from the first tension control module 140. The first velocity PID controller 146 is electrically connected to the second arithmetic unit 143 and receives the first velocity difference ΔW1 to perform a PID operation to the first velocity difference ΔW1 to output a first compensation torque ΔT1. If the first angular velocity W1 of the first motor 12 is not sufficient, the first compensation torque ΔT1, which is controlled by the first velocity PID controller 146, is positive; whereas, if the first angular velocity W1 of the first motor 12 is exceeded, the first compensation torque ΔT1 is negative. In addition, the fourth arithmetic unit 147 is electrically connected to the first tension PID controller 142, the first tension feedback calculation unit 144, the first velocity PID controller 146, and the third arithmetic unit 145 to calculate firstly the difference between the first torque T1 and the first resisting torque (F1×R1) and then calculate the sum of the first compensation torque ΔT1 and the above-mentioned torque difference. Thus, with the integrated tension and velocity closed loops, the net torque of the first motor 12 is equal to sum of a torque difference and the first compensation torque ΔT1, where the torque difference is between the first torque T1 and the first resisting torque (F1×R1). More particularly, the first motor 12 is driven by the first motor drive according to the torque mode to rotate the first rotating shaft 10 of the controlled mechanical system 100 so as to build the velocity control.

Similarly, the second arithmetic unit 243 is used to calculated a second velocity difference ΔW2, which is calculated by subtracting the second angular velocity W2 from the velocity command Wc (namely, ΔW2=Wc−W2). The second velocity difference ΔW2 is the difference between the expected velocity and the actual velocity generated from the second tension control module 240. The second velocity PID controller 246 is electrically connected to the second arithmetic unit 243 and receives the second velocity difference ΔW2 to perform a PID operation to the second velocity difference ΔW2 to output a second compensation torque ΔT2. If the second angular velocity W2 of the second motor 22 is not sufficient, the second compensation torque ΔT2, which is controlled by the second velocity PID controller 246, is positive; whereas, if the second angular velocity W2 of the second motor 22 is exceeded, the second compensation torque ΔT2 is negative. In addition, the fourth arithmetic unit 247 is electrically connected to the second tension PID controller 242, the second tension feedback calculation unit 244, the second velocity PID controller 246, and the third arithmetic unit 245 to calculate firstly the difference between the second torque T2 and the second resisting torque (F2×R2) and then calculate the sum of the second compensation torque ΔT2 and the above-mentioned torque difference. Thus, with the integrated tension and velocity closed loops, the net torque of the second motor 22 is equal to sum of a torque difference and the second compensation torque ΔT2, where the torque difference is between the second torque T2 and the second resisting torque (F2×R2). More particularly, the second motor 22 is driven by the second motor drive according to the torque mode to rotate the second rotating shaft 20 of the controlled mechanical system 100 so as to build the velocity control.

Figure 6:
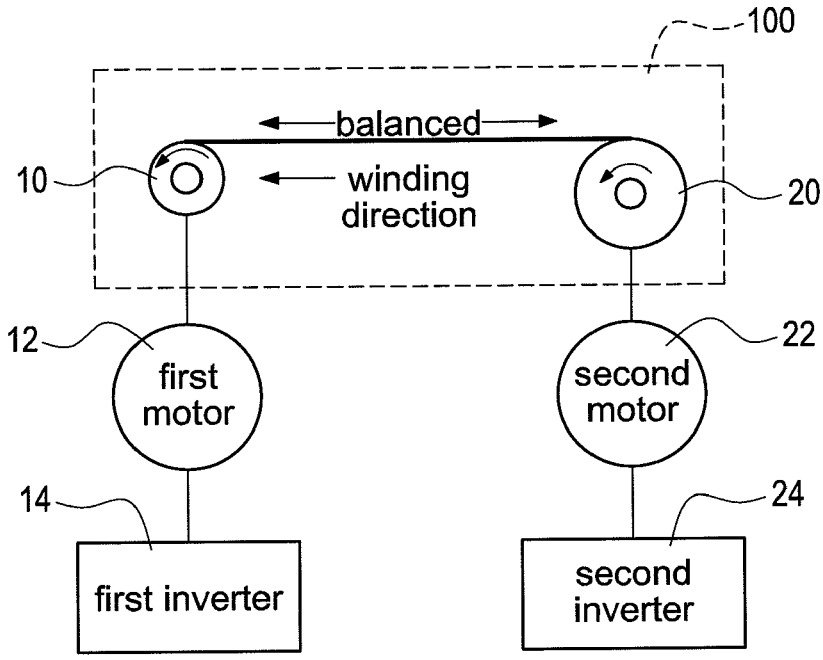
FIG. 6 is a schematic view of building the velocity control.

The above-mentioned integrated tension control and velocity control closed loops based on the torque control mode are employed to drive the first motor 12 and the second motor 22 to provide an accelerated or decelerated adjustment for the winding object 30, whereby the winding mechanism can stably maintain a tension-balanced operation. Reference is made to FIG. 6 is a schematic view of building the velocity control. When the winding object 30 is in a balanced condition, the first motor 12 and the second motor 22 are driven to rotate in the same direction. In this example, the first motor 12 and the second motor 22 both rotate in counter clockwise direction. Accordingly, the first rotating shaft 10 and the second rotating shaft 20 are rotated to perform the winding or unwinding operations. More particularly, the tension control is operated with a higher bandwidth than the velocity control to provide an accelerated or decelerated adjustment for the winding mechanism so that the winding mechanism can stably maintain a tension-balanced operation.

For the above-mentioned embodiments, the tension sensor or the line speed sensor is absent. However, the tension sensor and the line speed sensor can be also used to sense the magnitude of the tension force and the speed of the winding object 30*a*, respectively.

In conclusion, the present invention has following advantages:

1. The integrated tension and velocity closed loops can be provided for a low-cost, easy-use, high-acceptable, and wide-applicable tension-balanced control without any sensor.

2. The PID controllers of adjusting the tension control loops and the velocity control loops can be employed to increase stability of the tension control, thus maintaining the tension force and the velocity near the expected tension force and expected velocity, respectively.

3. During the accelerated or decelerated operations, the PID gains (including a proportional gain, an integral gain, and a derivative gain) of the first velocity PID controller 146 and the second velocity PID controller 246 can be appropriately adjusted, respectively, to significantly improve the feedback oscillation, thus increasing the yield rate of products and reduce material costs.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A built-in module for an inverter and having tension control with integrated tension and velocity closed loops, the tension control module applied to provide a tension control for a winding mechanism which operated by driving at least one motor, the tension control module comprising:

a first arithmetic unit receiving an external tension command;

a second arithmetic unit receiving an external velocity command;

a tension controller electrically connected to the first arithmetic unit to receive a tension force difference and perform a proportional, an integral, and a derivative (PID) operation to the tension force difference to output a torque;

a tension feedback calculation unit electrically connected to the first arithmetic unit to receive an angular velocity outputted from the motor and the torque calculated by the tension controller to output a feedback tension force; wherein the tension force difference is obtained by subtracting the feedback tension force from the external tension command through the first arithmetic unit;

a third arithmetic unit electrically connected to the tension feedback calculation unit to multiply the feedback tension force outputted from the tension feedback calculation unit by a winding radius of a rotating shaft of the winding mechanism to obtain a resisting torque;

a velocity controller electrically connected to the second arithmetic unit to receive a velocity difference and perform a PID operation to the velocity difference to output a compensation torque; wherein the velocity difference is obtained by subtracting the angular velocity from the external velocity command through the second arithmetic unit; and a fourth arithmetic unit electrically connected to the tension controller, the tension feedback calculation unit, the velocity controller, and the third arithmetic unit to obtain a net torque by subtracting the resisting torque from the torque to build a tension control; further the net torque added by the compensation torque to obtain another net torque to build a velocity control;

whereby the tension control module firstly builds the tension control to provide a balanced tension to the winding mechanism; afterward, the tension control module builds the velocity control to provide an accelerated or decelerated adjustment for the winding mechanism so that the winding mechanism can stably maintain a tension-balanced operation.

2. The built-in module for an inverter and having tension control in claim 1, wherein the tension control module synchronously controls the integrated tension control and velocity control.

3. The built-in module for an inverter and having tension control in claim 1, wherein the motor further comprises an encoder on a shaft thereof to measure the angular velocity of the motor.

4. The built-in module for an inverter and having tension control in claim 1, wherein the angular velocity of the motor is obtained by using a velocity estimation method.

5. The built-in module for an inverter and having tension control in claim 1, wherein the tension control is operated with a higher bandwidth than the velocity control.

6. The built-in module for an inverter and having tension control in claim 1, wherein the motor is driven through the inverter in a torque control mode.

* * * * *